US008613400B2

(12) United States Patent
Filicicchia et al.

(10) Patent No.: US 8,613,400 B2
(45) Date of Patent: Dec. 24, 2013

(54) ULTRASONIC ATOMIZING NOZZLE WITH CONE-SPRAY FEATURE

(75) Inventors: Daniel J. Filicicchia, Londonderry, NH (US); David C. Huffman, Merrimack, NH (US); Michel R. Thenin, Amherst, NH (US)

(73) Assignee: Spraying Systems Co., Wheaton, IL (US)

( * ) Notice: Subject to any disclaimer, the term of this patent is extended or adjusted under 35 U.S.C. 154(b) by 433 days.

(21) Appl. No.: 12/742,574

(22) PCT Filed: Nov. 19, 2008

(86) PCT No.: PCT/US2008/083993

§ 371 (c)(1),
(2), (4) Date: May 12, 2010

(87) PCT Pub. No.: WO2009/067488

PCT Pub. Date: May 28, 2009

(65) Prior Publication Data

US 2010/0258648 A1 Oct. 14, 2010

Related U.S. Application Data

(60) Provisional application No. 61/003,656, filed on Nov. 19, 2007.

(51) Int. Cl.
*B05B 7/10* (2006.01)

(52) U.S. Cl.
USPC ..... 239/403; 239/290; 239/102.1; 239/463

(58) Field of Classification Search
USPC ..... 239/102.1, 102.2, 290, 461, 463, 491, 239/403, 4, 8, 399
See application file for complete search history.

(56) References Cited

U.S. PATENT DOCUMENTS

| | | | | |
|---|---|---|---|---|
| 3,224,677 | A * | 12/1965 | Schmidt et al. | 239/101 |
| 3,746,257 | A * | 7/1973 | Broad et al. | 239/102.2 |
| 3,904,347 | A * | 9/1975 | Rokudo et al. | 431/1 |
| 4,245,784 | A | 1/1981 | Garcin | |
| 5,078,321 | A | 1/1992 | David et al. | |
| 5,186,389 | A * | 2/1993 | Shibano | 239/102.2 |
| 5,435,282 | A | 7/1995 | Haber et al. | |
| 2007/0164459 | A1 | 7/2007 | Gottlieb et al. | |

* cited by examiner

*Primary Examiner* — Jason Boeckmann
(74) *Attorney, Agent, or Firm* — Leydig, Voit & Mayer, Ltd.

(57) ABSTRACT

A nozzle assembly that produces a cone-shaped spray pattern of entrained liquid droplets is disclosed. The nozzle includes an ultrasonic atomizer for atomizing a liquid on an atomizing surface located at the end of an atomizing stem. The nozzle assembly is supplied pressurized air that is directed to the atomizing surface by intercommunicating ports, chambers and/or channels. To provide the cone-shaped spray pattern, the ports, chambers and/or channels cause or direct the pressurized gas to rotate about the atomizing stem. When the rotating pressurized gas exits the nozzle assembly via proximate the atomizing surface, atomized liquid droplets become entrained in the gas. The rotating pressurized gas propels the droplets forward and moves at least some droplets circumferentially outward in the cone-shaped spray pattern. In various embodiments, the pressure of the gas can be adjusted to control the size and shape of the cone-shaped pattern and the distribution of droplets.

6 Claims, 3 Drawing Sheets

ULTRASONIC ATOMIZING NOZZLE WITH CONE-SPRAY FEATURE

BACKGROUND OF THE INVENTION

It is known to use spray nozzles to produce a spray for a wide variety of industrial applications including, for example, coating a surface with a liquid. Typically, in a spray nozzle coating application, liquid is atomized by the spray nozzle into a mist or spray of droplets which is directed and deposited onto a surface or substrate to be coated. The actual droplet size of the atomized liquid and the shape or pattern of the spray discharged from the nozzle can be selected depending upon a variety of factors including the size of the object being coated and the liquid being atomized. Other applications for nozzles may include cooling applications or mixing of gases.

One known technique for atomizing liquids into droplets is to direct pressurized gas such as air into a liquid and thereby mechanically break the liquid down into droplets. In such gas atomization techniques, it can be difficult to control and/or minimize the size and consistency of the droplets. Another known type of spray nozzle is an ultrasonic atomizing nozzle assembly that utilizes ultrasonic energy to atomize a liquid into a cloud of small, fine droplets which is almost smoke-like in consistency. However, because of the fine size of the droplets and mist-like consistency of the atomized droplets, it can be difficult to control and direct them as a spray towards the surface to be coated. Moreover, because the fine droplets have little mass, the droplets may drift or become thinly dispersed shortly after discharge from the spray nozzle. The uniformity and/or distribution of the droplets within a pattern may be difficult to control and may deteriorate rapidly after discharge from the nozzle assembly making it difficult to coat a surface evenly. Because ultrasonically produced spray patterns made up of such fine droplets are difficult to shape and control, their use in many industrial applications is disadvantageously affected.

OBJECTS AND SUMMARY OF THE INVENTION

It is an object of the invention to produce a liquid spray of small fine, ultrasonically atomized droplets and to propel that spray forwardly onto a surface or substrate to be coated.

It is another object of the invention to provide a spray nozzle assembly operable to shape an ultrasonically atomized droplet cloud into a cone-shaped fan spray pattern useable in various industrial applications.

It is a further object of the invention to provide a spray nozzle capable of controlling and adjusting the angular width of a cone-shaped spray pattern and/or the distribution of atomized droplets within the cone-shaped spray pattern.

The foregoing objects can be accomplished by the inventive spray nozzle assembly that utilizes ultrasonic atomization to atomize a liquid into a fine droplet cloud and that also utilizes air or gas to propel the droplets forwardly in a substantially cone-shaped pattern. The precise shape of the conical spray pattern and the distribution of droplets within the pattern can further be selectively adjusted by manipulation of the gas stream used to shape and propel the atomized droplets.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE EMBODIMENTS

Figure 1:
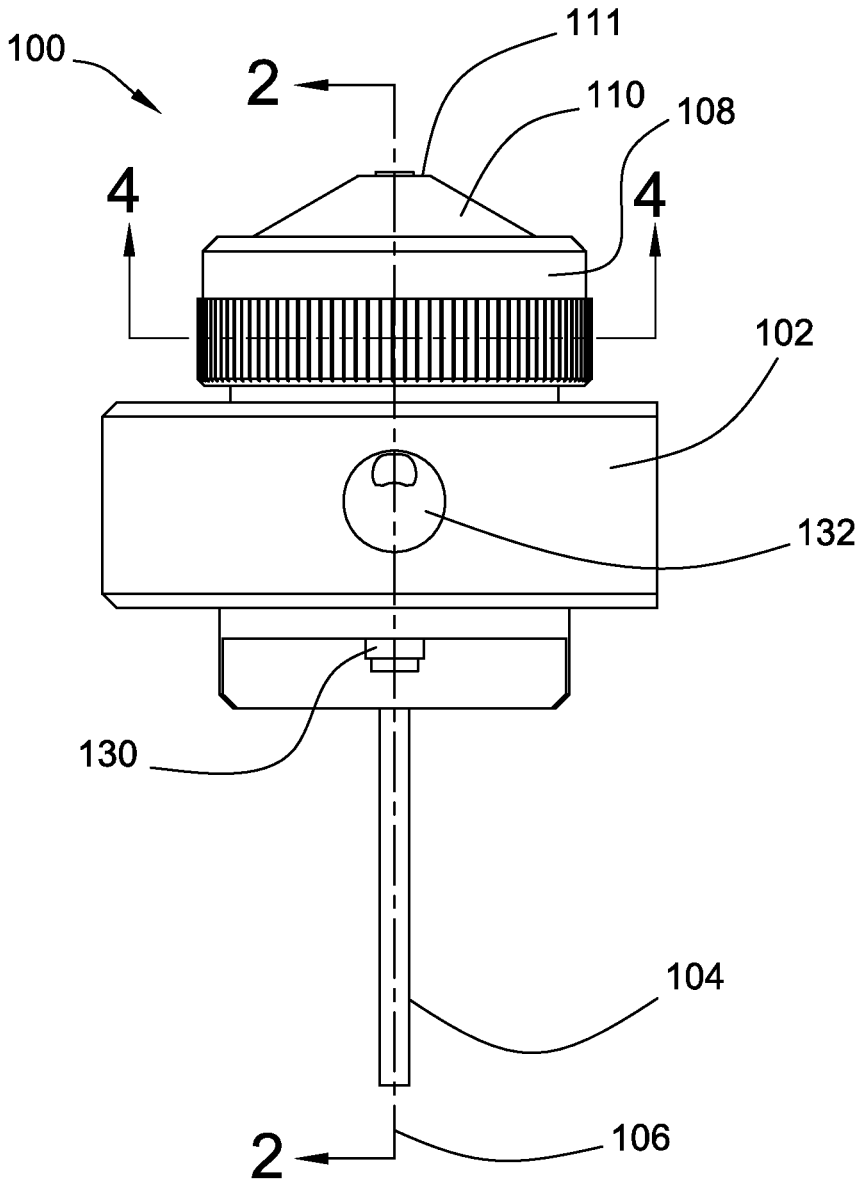
FIG. 1 is a side elevational view of a nozzle assembly designed in accordance with the invention for producing a conically shaped spray pattern of liquid droplets.

Now referring to the drawings, wherein like reference numbers refer to like features, there is illustrated in FIG. 1 a nozzle assembly 100 that can ultrasonically atomize a liquid into fine droplets and propel the droplets forward in a cone-shaped spray pattern. The nozzle assembly 100 includes a nozzle body 102 that may have a stepped cylindrical shape and from which extends in a rearward direction a liquid inlet tube 104 by which liquid may be taken into the nozzle assembly. For reference purposes, the stepped cylindrical shape of the nozzle body 102 and the liquid inlet tube 104 can extend along and generally delineate a centrally located axis line 106. Mounted to the front of the nozzle body 102 can be an air cap 110 from which the liquid can be forwardly discharged in the form of a conically shaped, atomized spray of fine droplets or particles. In the illustrated embodiment, the air cap 110 has a frustoconical or pyramid shape that terminates at a forward most, planar apex 111 that is axially perpendicular to the axis line 106. In other embodiments, though, the air cap 110 can have other shapes. It should also be noted that directional terminology such as "forward" and "reward" are for reference purposes only and are not otherwise intended to limit the nozzle assembly in any way. To mount the air cap 110 to the nozzle body 102, in the illustrated embodiment an annular threaded retention nut 108 is threaded onto the nozzle body so as to retentively clamp the air cap thereto.

Figure 2:
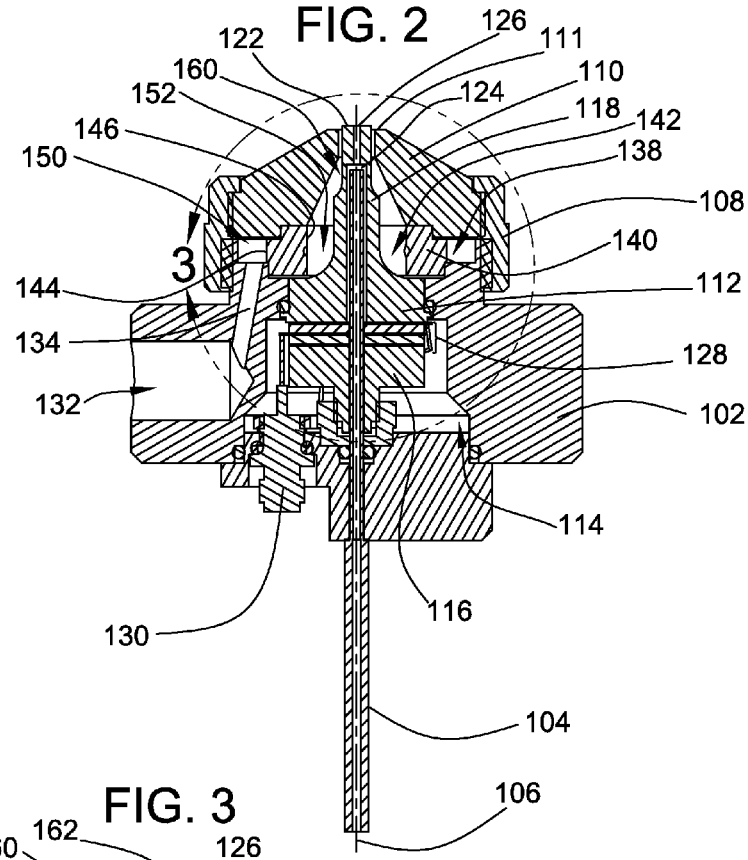
FIG. 2 is a cross-sectional view of the illustrated nozzle assembly, taken along lines 2-2 of FIG. 1 and illustrating the gas inlet ports, chambers and cavities inside the nozzle assembly for channeling and directing pressurized gas.

To ultrasonically atomize the liquid, as shown in FIG. 2, the nozzle assembly 100 also includes an ultrasonic atomizer 112 received within a central bore 114 that is disposed into the rear of the nozzle body 102. The ultrasonic atomizer 112 includes an ultrasonic driver 116 from which extends in the forward direction a rod-like cannular atomizer stem 118. In the illustrated embodiment, both the ultrasonic driver and the atomizer stem can be cylindrical in shape, with the ultrasonic driver having a substantially larger diameter than the atomizer stem. The cylindrical ultrasonic driver 116 and cannular atomizer stem 118 can also be arranged generally along the centrally located axis line 106. At its axially forward tip or end, the atomizer stem 118 terminates in an atomizing surface 122. To direct the liquid to be atomized to the atomizing surface 122, the cannular atomizer stem 118 forms a liquid feed passage 124 that is disposed through the atomizing surface to provide a liquid exit orifice 126. The liquid feed passage 124 extends along the axis line 106 and is in fluid communication with the liquid inlet tube 104 of the nozzle body 102. The ultrasonic atomizer can be comprised of a suitable material such as titanium.

To generate the ultrasonic vibrations for vibrating the atomizing surface 122, the ultrasonic driver 116 can include a plurality of adjacently stacked piezoelectric transducer plates or discs 128. The transducer discs 128 are electrically coupled to an electronic generator via an electrical communication port 130 extending from the rear of the nozzle body 102. Moreover, the transducer discs 128 can be electrically coupled so that each disc has an opposite or reverse polarity of an immediately adjacent disc. When an electrical charge is coupled to the stack of piezoelectric discs 128, the discs expand and contract against each other thereby causing the ultrasonic driver 116 to vibrate. The high frequency vibrations are transferred to the atomizing surface 122 via the atomizer stem 118, causing any liquid present at the atomizing surface to discharge into a cloud of very fine droplets or particles.

In accordance with an aspect of the invention, the nozzle assembly 100 is configured with intercommunicating gas passages that receive and direct pressurized gas to propel the atomized droplet cloud forward of the nozzle assembly to impinge upon a surface to be coated. The gas passages can also be arranged so that the pressurized gas shapes the atomized droplet cloud into a usable, cone-shaped spray pattern. To control and adjust the distribution of droplets within the cone-shaped pattern and to change the angular width of the cone-shaped pattern, the pressure and/or velocity of the incoming gas can be variably adjusted.

Figure 3:
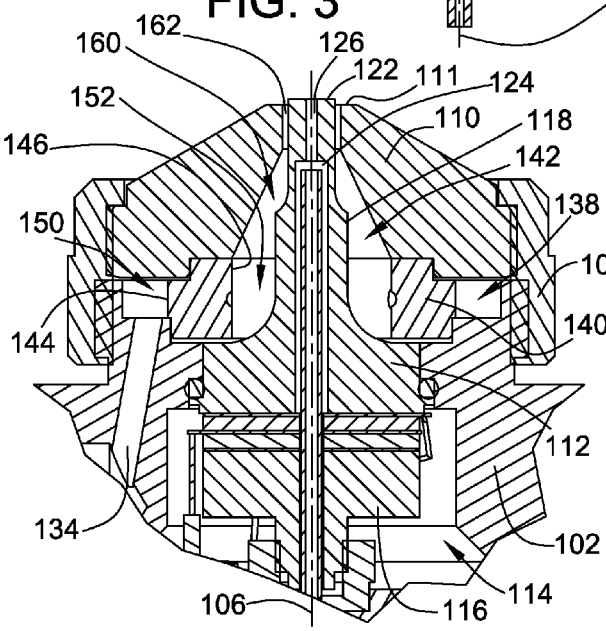
FIG. 3 is a detailed view of the area indicated by circle 3-3 of FIG. 2 showing in enlarged detail some of the inlet ports, chambers and cavities inside the nozzle assembly.

Referring to FIGS. 2 and 3, to receive the pressurized gas, the nozzle body 102 includes at least one inlet port 132 disposed radially into the cylindrical sidewall of the nozzle body and that can communicate with a pressurized gas source. In various embodiments, the inlet port 132 can be threaded or include other connection features to securely connect to the pressurized gas source in a leak tight manner. The incoming pressurized gas can be redirected in the axially forward direction toward the interface between the nozzle body 102 and the air cap 110 by a gas passageway 134 disposed from the inlet port 132 toward the axially forward face of the nozzle body.

To facilitate formation of the cone-shaped spray pattern, a rotational velocity is imparted to the forwardly directed pressurized gas stream so that the gas stream is made to rotate or swirl about the axis line 106 of the nozzle assembly 100. In the illustrated embodiment, to cause rotation of the gas, the nozzle assembly can include a rotational redirection member in the form of a whirl disk 140 located between the nozzle body 102 and the air cap 110. Specifically, the axially forward face of the nozzle body 102 is recessed to provide a circular cavity or recess 138 that can receive and accommodate the whirl disk 140 when the air cap 110 is mounted to the nozzle body. When assembled as such, the whirl disk 140 is generally perpendicular to the axis line 106.

The whirl disk 140 is a ring-shaped structure with a central hole or aperture 142 disposed through it. When set between the nozzle body 102 and the air cap 110, the ring-shaped whirl disk 140 extends in a radially offset manner about the axis line 106 and the atomizer stem 118 of the ultrasonic atomizer 112 extends through the central aperture 142. Moreover, the whirl disk 140 is sized so that its outer circular surface 144 has a smaller diameter than the diameter of the circular recess 138 of the nozzle body 102 while its inner circular surface 146 has a greater diameter than the atomizer stem 118. Accordingly, when placed in the circular recess 138, the whirl disk 140 separates the recess 138 into an outer annular chamber 150 formed between the outer circular surface 144 and the nozzle body 102 and an inner annular chamber 152 formed between the inner circular surface 146 and the atomizer stem 118. The outer annular chamber 150 and the inner annular chamber 152 can be aligned about the axis line 106 with the outer chamber surrounding the inner chamber such that both chambers are generally in the same axial plane. Although the outer and inner annular chambers are shown as being formed between circular sidewalls, it should be appreciated that in other embodiments the walls and/or chambers may have any other suitable shape.

Figure 4:
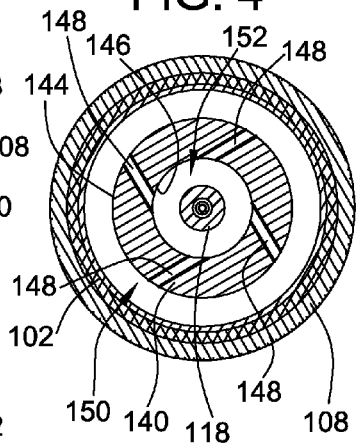
FIG. 4 is a cross-sectional view taken of the area indicated by circle 4-4 of FIG. 1 showing channels angularly disposed through a whirl disk that may be included as part of the nozzle assembly.

Referring to FIGS. 2 and 3, when the nozzle assembly is assembled, the passageway 134 from the inlet port 132 is arranged so that it communicates with the outer annular chamber 150. Referring to FIG. 4, to direct the pressurized gas from the outer annular chamber 150 to the inner annular chamber 152 in such a manner as to impart rotation or swirl to the gas, there can be disposed through the whirl disk 140 one or more channels 148 extending between the outer circular surface 144 and the inner circular surface 146. The channels 148 can be angularly arranged with respect to the axis line 106 so that they intersect the inner annular chamber 152 roughly on a tangent. In other words, the channels 148 can be perpendicular to and radially offset from the axis line 106. Thus, as the incoming pressurized gas is introduced to the inner annular chamber 152 at a tangential angle, the annular shape of the inner chamber will cause incoming gas to rotate about the atomizer stem 118 and the axis line 106. Thus, the pressurized gas stream has rotation or swirl imparted to it. In the embodiment illustrated in FIG. 4, the whirl disk 140 includes four straight channels 148 arranged orthogonally to one another. In other embodiments, different numbers and orientations of channels can be employed including, for example, curved channels.

Referring back to FIGS. 2 and 3, the inner annular chamber 152 in turn communicates with a tapering void 160 disposed into the rear axial face of the air cap 110. The void 160 tapers in the axially forward direction and can be disposed through the planar apex 111 of the air cap 110. The intersection of the tapering void 160 and the planar apex 111 can form a circular discharge orifice 162 aligned about the axis line 106. When installed into the nozzle assembly 100, the atomizer stem 118 of the ultrasonic atomizer 112 can be received through the tapering void 160 and the discharge orifice 162. To accommodate the cylindrical atomizer stem 118, the discharge orifice 162 can have a slightly larger diameter than the stem. Preferably, the tip of the atomizer stem 118 protrudes through the discharge orifice 162 so that the atomizing surface 122 is located slightly axially forward of the planar apex 111 of the air cap 110. Because the cylindrical atomizer stem 118 is received through the larger circular discharge orifice 162, the discharge orifice assumes an annular shape.

In operation, the liquid to be sprayed is fed into the liquid feed passage 124 through the cannular atomizer stem 118 to the atomizing surface 122. To assist in forcing the liquid to the atomizing surface 122, the liquid can be gravity fed or pressurized by a low-pressure pump. Liquid from the liquid feed passage 124 exits the liquid exit orifice 126 and can collect about the atomizing surface 122 by a capillary-like or wicking-like transfer action. The ultrasonic driver 116 can be electrically activated so that the piezoelectric discs 128 expand and contract to generate transverse or radial vibrations of the atomizer stem 118 and the atomizing surface 122. The vibrations experienced at the atomizing surface 122 can be at the frequency of about 60 kilohertz (kHz), although the frequency can be adjusted depending upon the liquid to be atomized, droplet size desired, or other factors. The transverse or radial vibration agitates the liquid within the liquid feed passage 124 and the liquid collected on the atomizing surface 122 such that the liquid is shaken from or separates from the atomizing surface in small, fine droplets. The size of the droplets can be on the order of about 5-60 microns, and may preferably range between about 8-20 microns. The droplets form a directionless cloud or plume generally proximate to the atomizing surface 122.

To propel the atomized droplets forward of the atomizing surface in a cone-shaped spray, pressurized air or other gas is introduced to the inlet port 132 and directed to the outer annular chamber 150. The gas can be air or any other suitable gas depending upon the application and can be supplied at a pressure on the order of 1-3 PSI. From the outer annular chamber 150, the pressurized gas is directed via the angular channels 148 and introduced in a roughly tangential manner to the inner annular chamber 152 where the gas is made to rotate about the atomizer stem 118. The swirling gas is further channeled axially forward to the discharge orifice 162 via the tapering void 160 in the air cap 110. As can be appreciated, because of the tapered shape of the void 160, the swirling pressurized gas stream flowing through the void can be further compressed and accelerated.

The pressurized gas exiting through the discharge orifice 162 will entrain the liquid droplet cloud present about the atomizing surface 122. The discharged gas thereby carries the droplets forward towards the surface to be coated. Because of the annular shape of the discharge orifice 162, the spray pattern of the pressurized gas—droplet mixture normally would assume a cylindrical shape or possibly the shape of a narrow cone. However, because the discharging pressurized gas is rotating or swirling, a circumferential momentum is imparted to the entrained droplets causing at least some of the forwardly propelled droplets to also move radially outward with respect to the axis line 106. Hence, the droplets tend to flare outwards and the nozzle assembly thereby produces a conical spray pattern that can be wider than otherwise possible without swirling or rotating the gas.

Without an intent to be constrained to particular examples, it is believed that the foregoing nozzle assembly may produce a conical spray pattern having a conical discharge angle on the order of 30°, in contrast to a discharge angle of about 15° that may be possible without spinning or rotating the propelling gas. One advantage of the wider conical spray pattern is that the nozzle assembly can cover a larger area on the surface to be coated within a given time.

In an advantageous embodiment of the spray nozzle assembly 100, the pressure of gas being delivered to provide the forward-propelling cone-shaped spray pattern can be manipulated to adjust the shape of the cone-shaped spray pattern and to vary the droplet distribution within the cone-shaped spray pattern. For example, increasing the pressure of the gas being communicated to the inlet port 132 can increase the circumferential forces accompanying the rotating gas in the inner annular chamber 152. The increased circumferential force within the pressurized gas will, as the gas discharges through the exit orifice 162 and collects the droplet cloud, force a larger number of droplets radially outward from the axis line 106. This results in both a wider angle to the cone-shaped spray pattern and a larger distribution of the droplets toward the outer diameters of the cone-shaped spray pattern. Reducing the pressure of the gas correspondingly results in a narrower cone-shaped spray pattern and a larger number of droplets being distributed closer toward the axis line 106. To adjust the pressure of the gas, the nozzle assembly can be connected to a pressure regulator.

Figure 5:
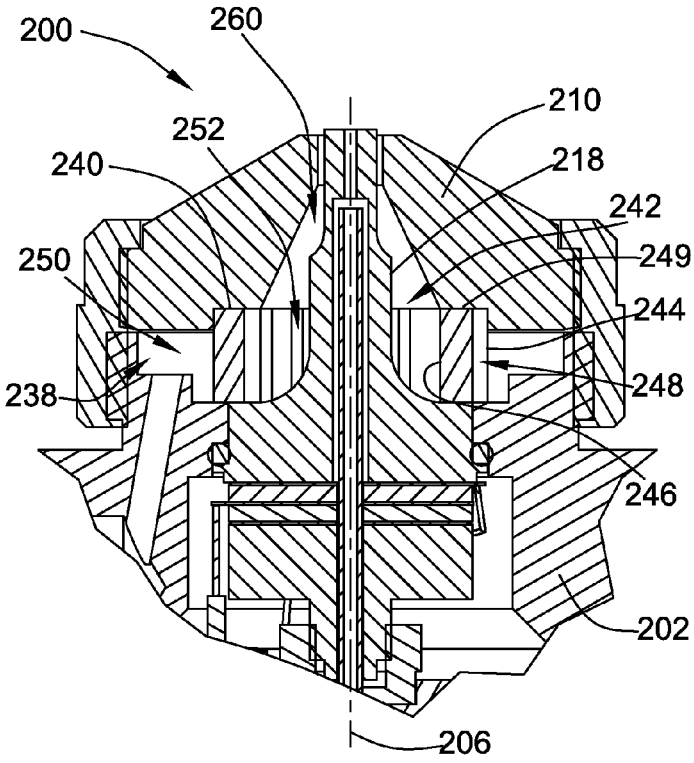
FIG. 5 is a detailed view, similar to that shown in FIG. 3, of another embodiment of the nozzle assembly showing a different arrangement of the inlet ports, chambers and cavities inside the nozzle assembly for producing a conically shaped spray pattern of liquid droplets.
Figure 6:
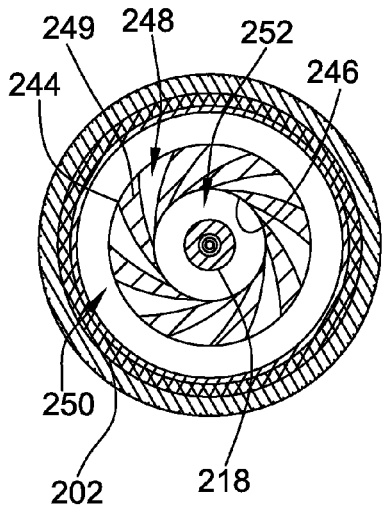
FIG. 6 is a cross-sectional view, similar to that shown in FIG. 4, of the embodiment of the nozzle assembly of FIG. 5 showing the channels disposed through a fin disk that may be included as part of the nozzle assembly.

Referring to FIGS. 5 and 6, there is illustrated another embodiment of a nozzle assembly 200 in which a rotational redirection member in the form of a fin disk 240 is utilized to assist in producing a conically-shaped spray pattern. As illustrated in FIG. 5, the fin disk 240 can be located between the nozzle body 202 and the air cap 210. To accommodate the fin disk 240, a circular recess 238 can be disposed into the front face of the nozzle body 202. The fin disk 240 can be a ring-shaped structure delineating a central aperture 242 and can have an outer circular periphery 244 and an inner circular periphery 246. When assembled between the nozzle body 202 and the air cap 210, the ring-shaped fin disk 240 is axially centered about the axis line 206 such that the atomizing stem 218 passes through the central aperture 242. Moreover, the outer circular periphery 244 can have a diameter less than that of the circular recess 238 while the inner circular periphery 246 can have a diameter greater than that of the cylindrical atomizing stem 218. Accordingly, the circular recess 238 disposed into the nozzle body 202 is separated into an outer annular chamber 250 between the outer circular periphery 244 and the recess and an inner annular chamber 252 between the inner circular periphery 246 and the atomizing stem 218.

As illustrated in FIGS. 5 and 6, the fin disk 240 can include a plurality of circumferentially arranged fins 249 made of a structural material. Delineated between each of the fins 249 is a channel 248 establishing communication between the outer annular chamber 250 and the inner annular chamber 252. Moreover, the fins 249 can be generally arch-shaped so that they curve between the outer circular periphery 244 and the inner circular periphery 246 of the fin disk 240. Hence, the channels 248 intersect the inner annular chamber 252 roughly on a tangent at least with respect to the atomizer stem 218 and the axis line 206. In various embodiments, the plurality of fins 249 can be shaped and arranged in a converging manner with one another so that the channels 248 have a decreasing cross-sectional area as they extend between the outer circular periphery 244 and the inner circular periphery 246.

In operation, pressurized gas directed into the outer annular chamber 250 from the inlet ports can enter the channels 248 of the fin disk 240 through the outer circular periphery 244. The channels 248 then direct the pressurized gas to the inner annular chamber 252 while also imparting rotation or spin to the gas due to the curved shape of the fins 249. Hence, as gas enters the inner annular channel in a roughly tangential manner the gas will rotate about the axis line 206 and atomizing stem 218. As will be appreciated, the gas will continue to spin or rotate as it enters the tapering void 260 disposed into the air cap 210 and as it discharges from the nozzle assembly 200, thereby assisting in forming the conical shaped spray pattern as described above. In those embodiments in which the channels 248 are shaped to have a decreasing cross-sectional area, the reduction in area will cause the pressurized gas to accelerate as the gas progresses through the channel from the outer annular chamber to the inner annular chamber.

As will be appreciated by those of skill in the art, embodiments of the inventive nozzle assembly capable of carrying out the foregoing features and processes may structurally vary from the presently described embodiments. For example, the rotational redirection member can be eliminated and the angled channels, annular chambers, and/or fins can be disposed into the nozzle body, air cap or other component of the nozzle assembly. In other embodiments, the annular chambers may be eliminated and pressurized gas can discharge directly through the rotational redirection member and into the air cap. Additionally, other arrangements and orientations of the channels, chambers, and passages are contemplated and fall within the scope of the invention.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pressurized air assisted, ultrasonic atomizing nozzle assembly comprising:

a nozzle body including a gas inlet port;

an air cap mounted on the nozzle body, having a discharge orifice in fluid communication with the gas inlet port;

an ultrasonic atomizer including an ultrasonic driver and a cannular atomizing stem extending along an axis line from said ultrasonic driver centrally into said air cap, said atomizing stem terminating in an atomizing surface, said cannlar atomizing stem defining a liquid passage for directing liquid to said atomizing surface where liquid is ultrasonically atomized into fine liquid droplets;

said ultrasonic atomizer being mounted on said nozzle body such that said atomizing stem extends forwardly from said nozzle body;

a ring shaped whirl disc disposed about said atomizing stem defining an inner annular gas chamber between said whirl disc and atomizing stem and an outer annular gas chamber about an outer periphery of said whirl disc;

said gas inlet port communicating with said outer annular gas chamber; and said whirl disc having a plurality of angled openings extending there through communicating between said outer gas chamber and said inner gas chamber for directing all gas from said gas inlet port to said inner annular gas chamber for rotation about the atomizing stem in said inner air chamber and direction about the atomizing surface for propelling the fine atomized liquid droplets forwardly of the atomizing surface in a cone shaped spray pattern.

2. The nozzle assembly of claim 1, wherein gas from said inlet port exits said discharge orifice in a cone-shaped pattern of about 30°.

3. The nozzle assembly of claim 1, wherein said first and second annular chambers are radially aligned with said axis line.

4. The nozzle assembly of claim 1 in which said angled openings tangentially communicate with said inner gas chamber.

5. The nozzle assembly of claim 1 in which said whirl disc is mounted in interposed relation between said air cap and said ultrasonic atomizer.

6. The nozzle assembly of claim 5 in which said whirl disc is retained in interposed relation between said atomizing stem and air cap by a retaining ring that secures the air cap to said nozzle body.

* * * * *